US006145781A

United States Patent [19]

Kawabe et al.

[11] Patent Number: 6,145,781

[45] **Date of Patent: *Nov. 14, 2000**

[54] CABLE STORAGE CASE PERMITTING EASY REMOVAL OF CABLE STORED THEREIN

[75] Inventors: Shizuya Kawabe; Takakazu Ishida; Koichi Kawamura; Yasuhiro Deguchi; Seigo Nakano; Hatsushige Fujita, all of Yokkaichi, Japan

[73] Assignee: Sumitomo Wiring Systems, Ltd., Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/114,040

[22] Filed: Jul. 10, 1998

[30] Foreign Application Priority Data

Jul. 10, 1997 [JP] Japan ..... 9-185113
Jul. 10, 1997 [JP] Japan ..... 9-185114

[51] Int. Cl.[7] ..... B65H 75/38

[52] U.S. Cl. ..... 242/588.6; 242/597.7; 242/914; 242/132

[58] Field of Search ..... 242/588.6, 588.3, 242/590, 597.7, 613, 613.1, 613.2, 614, 914, 137, 132, 146, 345.3

[56] References Cited

U.S. PATENT DOCUMENTS

| | | | |
|---|---|---|---|
| 231,796 | 8/1880 | Hayes | 242/134 X |
| 1,102,128 | 6/1914 | Bastian | 242/597.7 |
| 2,554,615 | 5/1951 | Dahle | 242/146 |
| 2,954,942 | 10/1960 | La Raus . | |
| 2,965,331 | 12/1960 | Nagy . | |
| 3,199,805 | 8/1965 | Kohn et al. | 242/597.7 X |
| 3,680,810 | 8/1972 | Jarmalow | 242/146 X |
| 4,085,907 | 4/1978 | Suzuki et al. | 242/345.3 X |
| 4,184,647 | 1/1980 | Rourke | 242/597.7 X |
| 4,376,519 | 3/1983 | Ishida et al. | 242/345.3 |
| 4,623,063 | 11/1986 | Balkin | 242/137 X |
| 4,765,563 | 8/1988 | Satoyoshi et al. | 242/345.3 X |
| 4,913,369 | 4/1990 | Lia et al. | 242/580 X |
| 4,953,810 | 9/1990 | Stadig | 242/597.7 X |
| 5,139,210 | 8/1992 | Schaffer . | |
| 5,775,632 | 7/1998 | Huerta | 242/613.2 X |
| 5,915,641 | 6/1999 | Barberg | 242/588.6 |
| 5,938,141 | 8/1999 | Kanbar | 242/597.7 X |

FOREIGN PATENT DOCUMENTS

| | | | |
|---|---|---|---|
| 63-154434 | 10/1988 | Japan . | |
| 58 57 57 | 11/1993 | Japan . | |
| 82 25 253 | 9/1996 | Japan . | |
| 11517 | 5/1912 | United Kingdom | 242/597.7 |
| 1186600 | 4/1970 | United Kingdom | 242/197 |

*Primary Examiner*—Donald P. Walsh
*Assistant Examiner*—Collin A Webb
*Attorney, Agent, or Firm*—Bierman, Muserlian and Lucas

[57] ABSTRACT

A cable storage assembly including a storage case, a cable coil within the storage case, and an outlet opening in the side of the case through which the cable is withdrawn. A disc-shaped base is provided on the floor of the case and the cable coil is located thereon. This permits rotation of the coil and base more readily than prior art devices. The Invention also includes the provision of one or more low-friction sheets between the floor of the case and the base which will further enhance the ability of the assembly to deliver the cable easily. The sheets may be replaced by a bearing which contacts the floor at a very limited area, compared to that of the base, which aids in additional friction reduction. If it is desired to fabricate the case out of thin cardboard, plastic, or the like, a planar hard support is provided on the floor and the bearing rests thereon. In all cases, the amount of force necessary to withdraw the cable is drastically reduced.

14 Claims, 7 Drawing Sheets

CABLE STORAGE CASE PERMITTING EASY REMOVAL OF CABLE STORED THEREIN

This Application claims the benefit of priority of Japanese Applications 9-185113 and 9-185114, filed Jul. 10, 1997.

The present Invention is directed to a cable storage assembly which is suitable for transportation and storage of coiled cable and which permits easy withdrawal at the time of usage. More specifically, it is directed to an assembly wherein the coiled cable readily rotates as the strand is pulled out of the case.

BACKGROUND OF THE INVENTION

Cable storage assemblies in accordance with the prior art are shown in FIGS. 11 and 12 hereof. Referring to FIG. 11, case 100 is customarily made of cardboard or similar material. Cable K is wound therein in the form of cable coil 102. When it is desired to use cable K, it is withdrawn through extraction opening 101.

However, due to the nature of this assembly, the coils of cable K do not untwist when removal takes place; therefore, there is a tendency for the cable to be bent or kinked. In an extreme case, its electrical properties can be impaired.

Another prior art assembly is shown in FIG. 12. Cable K, as it is wound, is pretwisted once for each coil. Thus, when cable K is withdrawn from coil 102*b*, the pretwists are cancelled out and withdrawal takes place without kinking or bending. However, this arrangement also has serious drawbacks. When cable K is pretwisted as described, it is stored in a very loose, low-density configuration. As a result, cable coil 102*b* takes up a large amount of space and, therefore, much less cable can be stored in a single case. This is inefficient in terms of both transportation and storage. Furthermore, a special device is necessary in order to pretwist the cable.

SUMMARY OF THE INVENTION

The foregoing problems are solved by the present Invention. The cable storage case contains the cable coiled around an axis substantially perpendicular to the floor of the case. An outlet opening is provided in the case to permit the cable to be withdrawn. A disc-shaped base rests on the floor and the cable coil, in turn, rests on the base. Thus, as the cable is withdrawn through the outlet opening, the coil and base rotate about the axis.

In a preferred form of the Invention, the base is provided with a cable support shaft perpendicular to the base and located at the axis. This acts as a center about which the cable coil is wound. In modifications of the foregoing, the cross section of the support shaft may be circular or non-circular. In the latter case, a polygonal cross section (e.g. a hexagon) has been found useful, as well as a cross section in the shape of an X.

As a further improvement, a disc-shaped sheet can be located between the base and the floor. The first coefficient of friction between the sheet and the floor is advantageously less than the second coefficient of friction between the base and the floor. Thus, the cable coil can be rotated more easily. As a further alternative, the sheet can be replaced by a solid or liquid lubricant. This also provides the ease of rotation which is a feature of this Invention. Of course, the lubricant may also be used in conjunction with the sheet, rather than as a replacement for it. In such a situation, the lubricant can be located between the sheet and the floor of the case, between the base and the sheet, or both.

In another embodiment of the present Invention, a bearing is provided between the base and the floor in line with the axis. In one form of the Invention, the bearing is a button which has a very small area in contact with the floor of the case. As a result, friction is extremely low and withdrawal of the cable from its coil is facilitated.

A modification of the foregoing consists in the provision of a support which rests on the floor of the box. This would normally be substantially rigid, in order to lend strength. The bearing can be mounted either on the under surface of the base or the upper surface of the support. This has a particular advantage in that the rigid support permits the use of thinner and/or lighter-weight cases to hold the desired amount of cable.

The outlet opening is most advantageously located in one of the sides of the case, preferably closer to one edge than to the other. This places the opening approximately adjacent the point from which the cable is uncoiled. Since the opening is in the side, rather than at the top, there is no tendency to twist the wire.

BRIEF DESCRIPTION OF THE DRAWINGS

In the accompanying drawings, constituting a part hereof, and in which like reference characters indicate like parts.

DETAILED DESCRIPTION OF THE INVENTION

Figure 1:
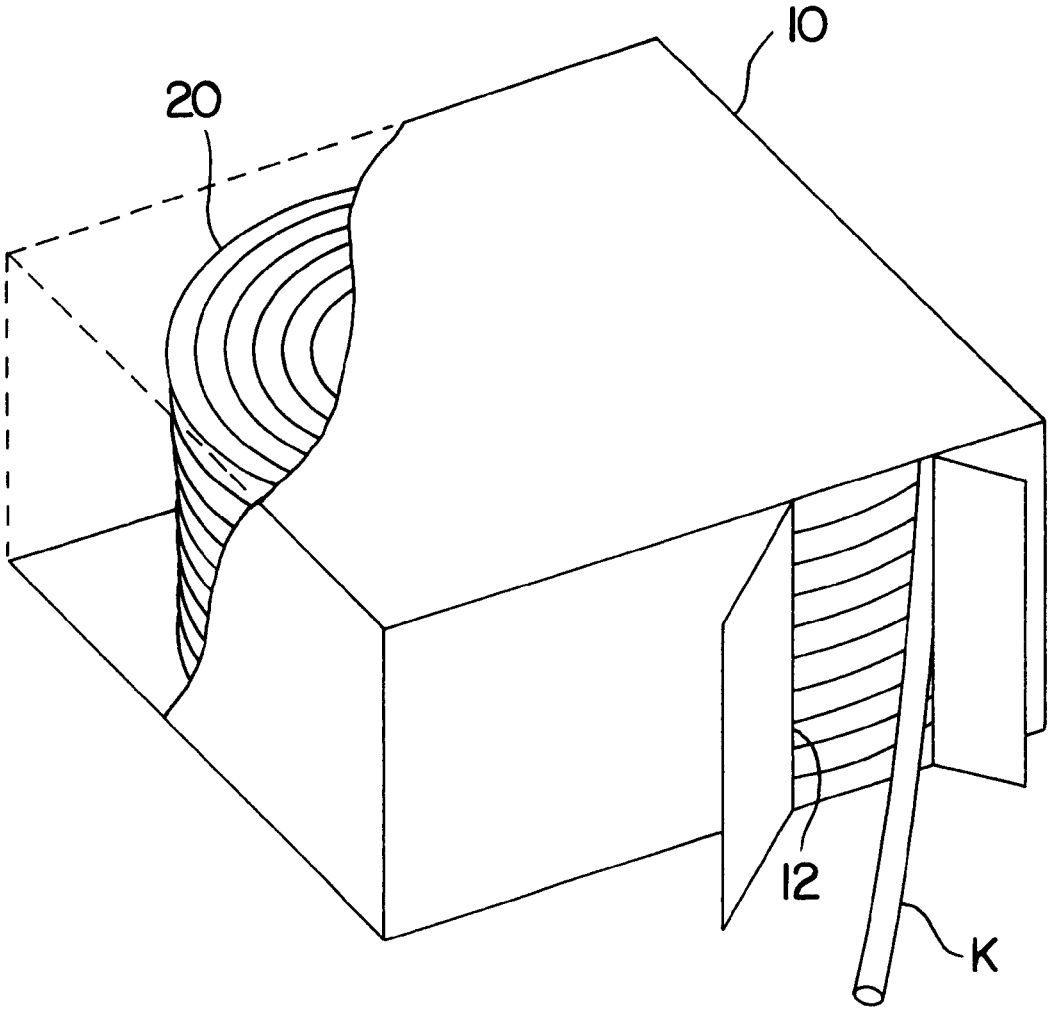
FIG. 1 is a prospective view of the present Invention, with the case partially broken away.

Cable storage case 10 contains cable coil 20 and is provided with outlet opening 12. Cable K is to be withdrawn therefrom. Base 30, carrying cable support shaft 34, is placed so that support shaft 34 is within cable coil 20. Sheet 40 may be placed beneath base 30 and between it and the floor of storage case 10. It is desirable that the coefficient of friction between sheet 40 and base 30 or floor 11 of storage case 10 be less than the coefficient of friction between the undersurface of base 30 and floor 11. In an alternative form of the device, a second sheet 40, of similar characteristics, may also be provided.

Figure 3:
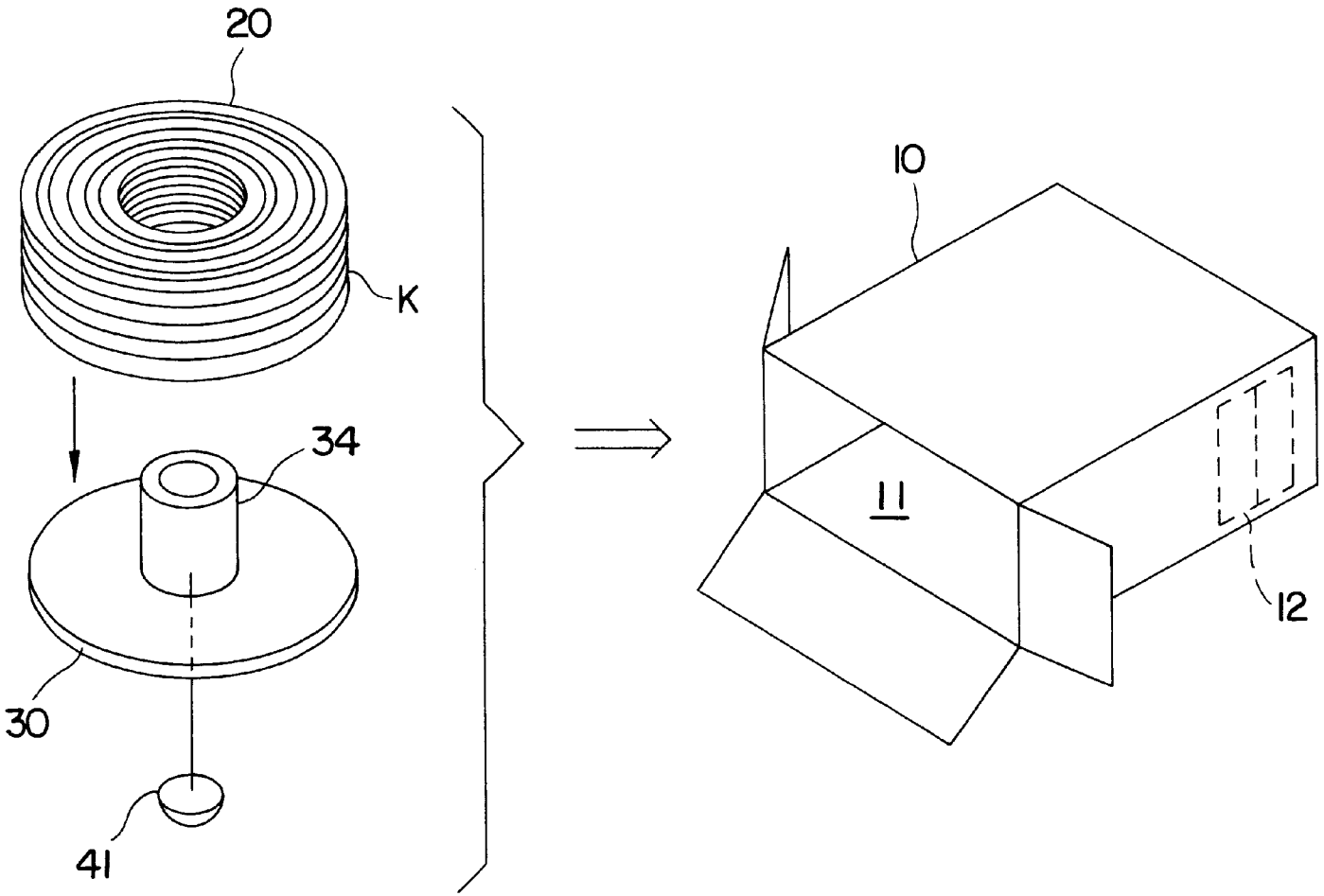
FIG. 3 is a view, similar to that of FIG. 2, of a modification of the present Invention.
Figure 4:
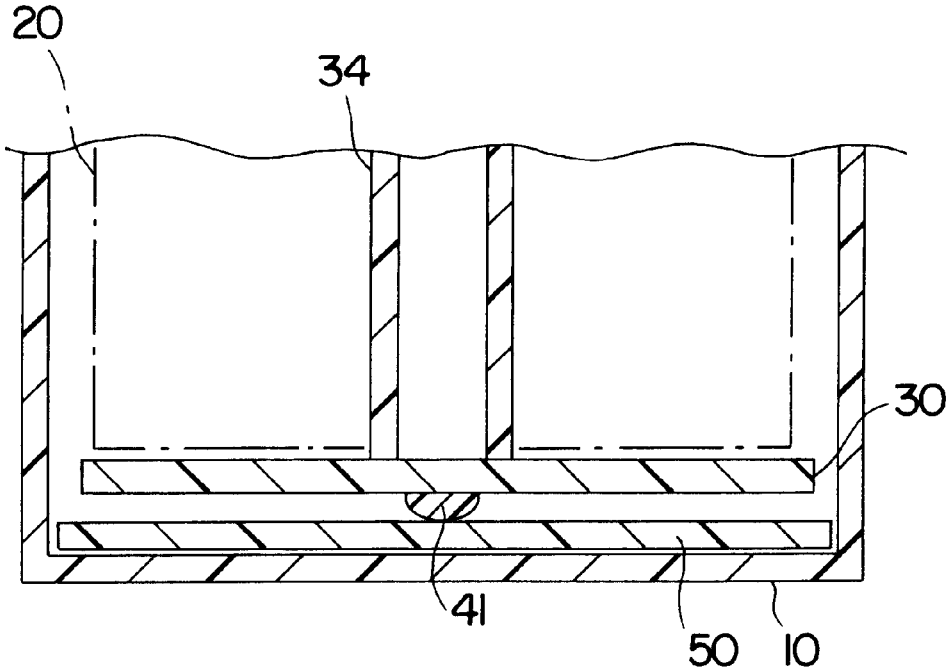
FIG. 4 is a sectional view of the assembled Invention as shown in FIG. 3.
Figure 5:
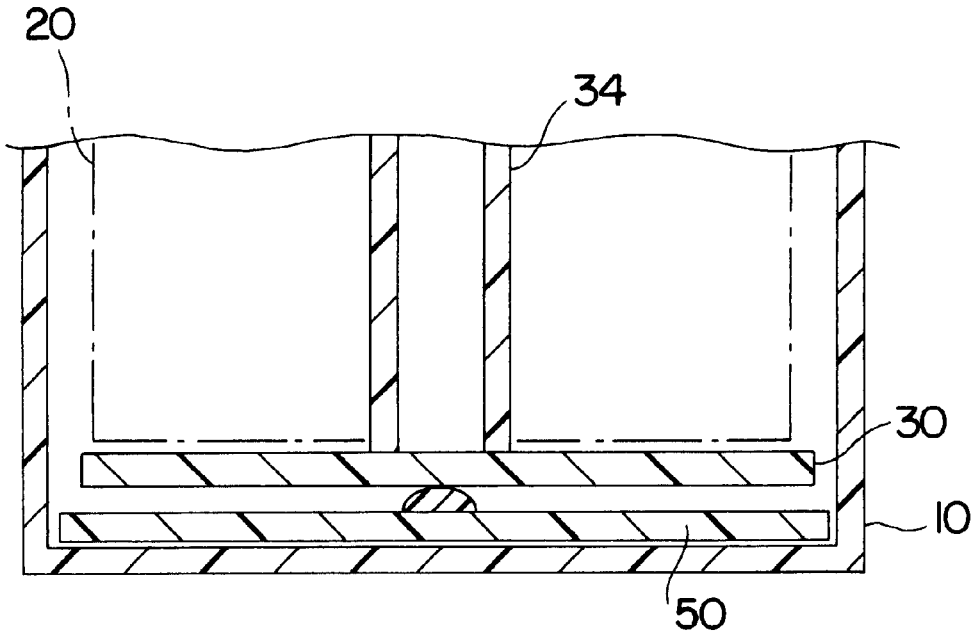
FIG. 5 is similar to FIG. 4, showing a variation thereof.

In a further embodiment of the present Invention, as best shown in FIGS. 3 to 5, base 30 is provided with bearing 41 which may be used in place of sheet 40. In a particularly preferred form of the Invention, support 50 is placed on floor 11 of storage case 10 in order to stiffen it. Thus, support 50 is advantageously relatively rigid so that the remainder of storage case 10 can be made of relatively thin cardboard or plastic. Support 50 not only strengthens floor 11, but also provides a hard surface upon which bearing 41 can rest. This maintains base 30 spaced apart from support 50 and thereby minimizes the friction generated by rotation of coil 20 and base 30. As can be seen from FIGS. 4 and 5, bearing 41 may be located either on the underside of base 30 or on the upper surface of support 50, with substantially equal effect.

Figure 6:
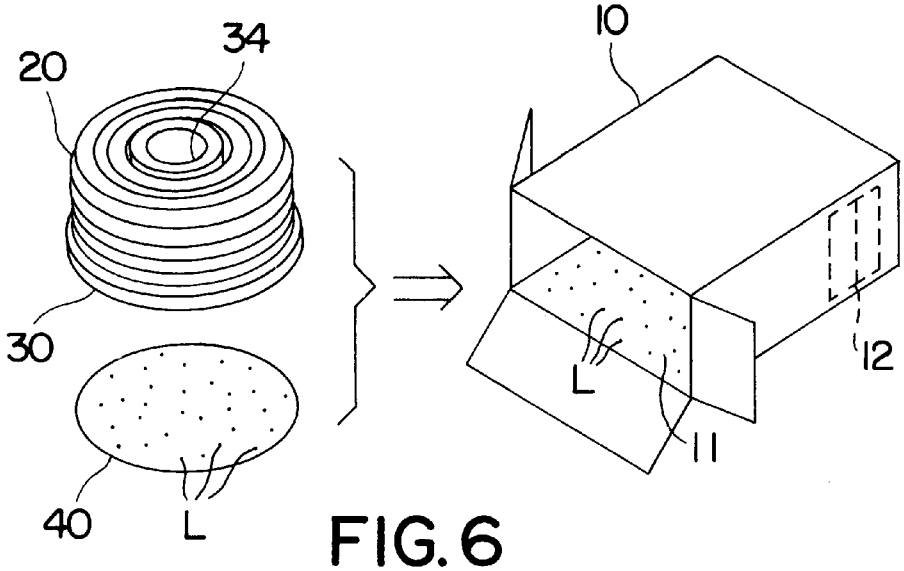
FIG. 6 is a view, similar to that of FIG. 2, showing the lubricant on the sheet and the floor of the case.
Figure 7:
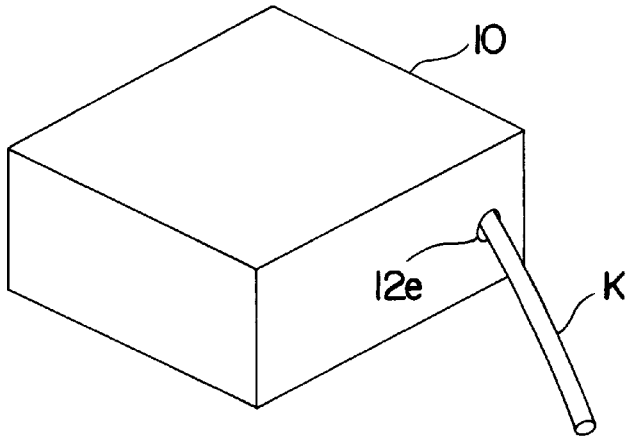
FIG. 7 is a perspective view showing removal of the cable from the case.
Figure 8:
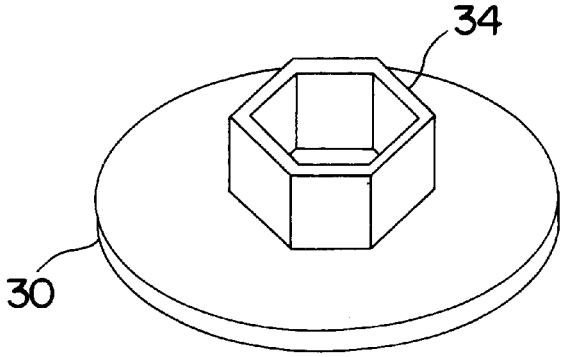
FIG. 8 is a further embodiment of the present Invention wherein the cable support shaft is hexagonal.

Alternatively or additionally, as shown in FIG. 6, lubricant L can be introduced onto one or more of floor 11 of storage case 10, the surfaces of sheet(s) 40, and the underside of base 30. In the Invention as shown in FIG. 1, the lubricant may be introduced between base 30 and floor 11. FIG. 7 shows cable K being withdrawn from storage case 10 through outlet opening 12*e*.

Figure 2:
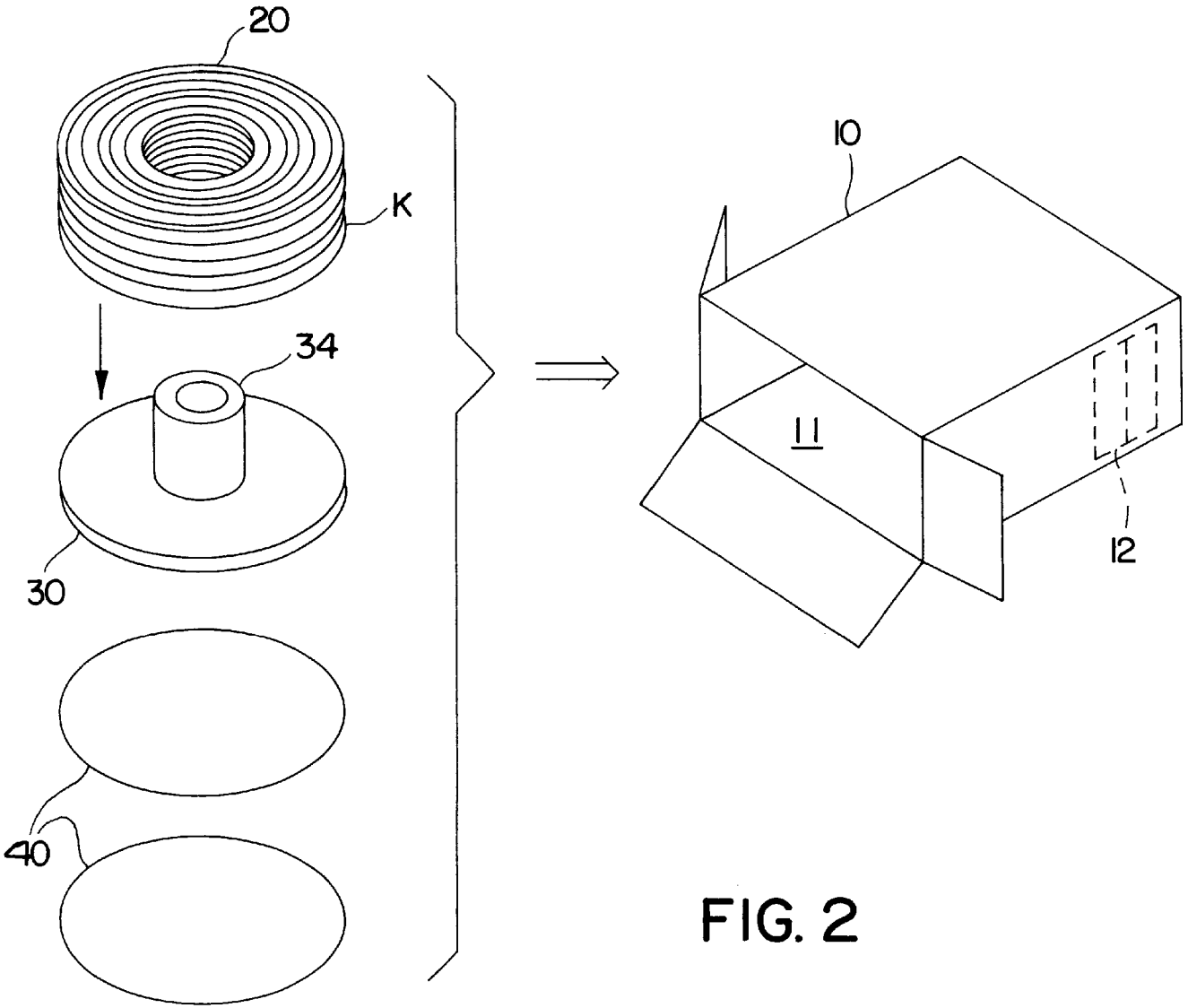
FIG. 2 is an exploded view showing the various elements to be inserted into the case.
Figure 10:
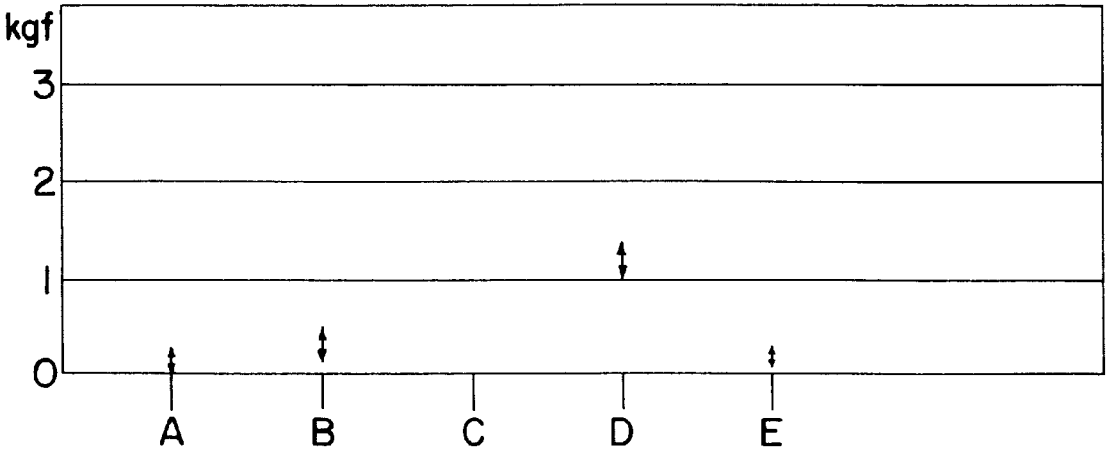
FIG. 10 is a graph showing the relationship between the force needed to withdraw the cable and the various configurations of both the prior art and the present Invention.
Figure 9:
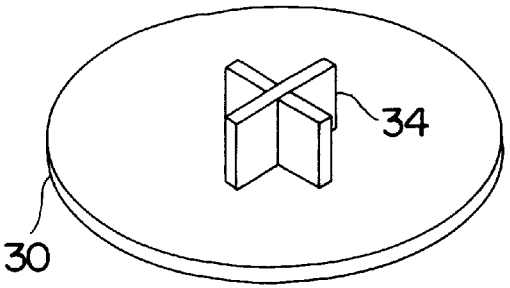
FIG. 9 is a view, similar to that of FIG. 8, wherein the support shaft has an X-shaped cross section.
Figure 11:
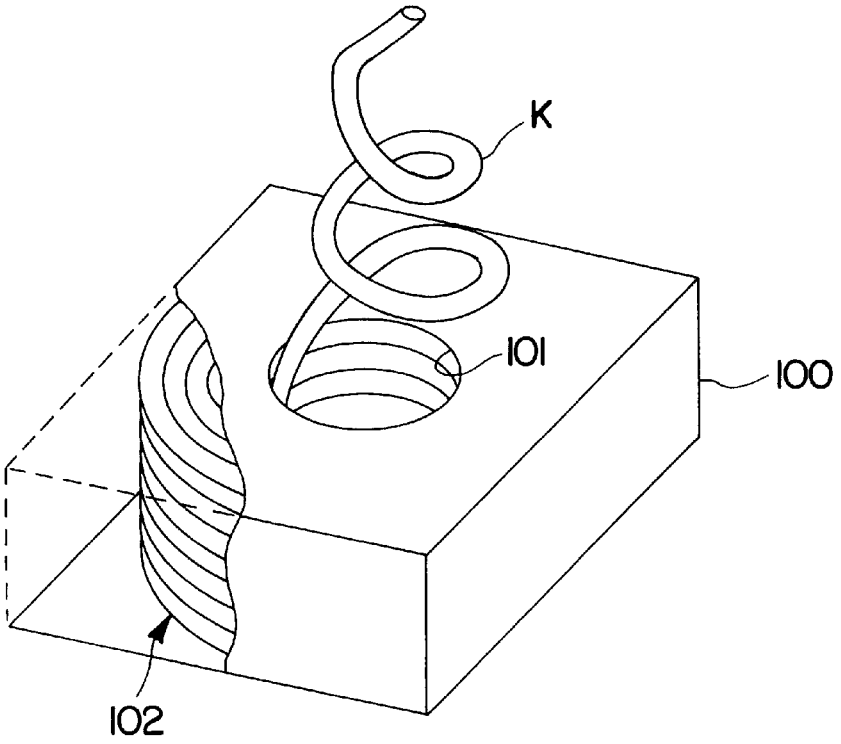
FIG. 11 PRIOR ART
FIG. 11 is a view, similar to that of FIG. 1, of a prior art device.
Figure 12:
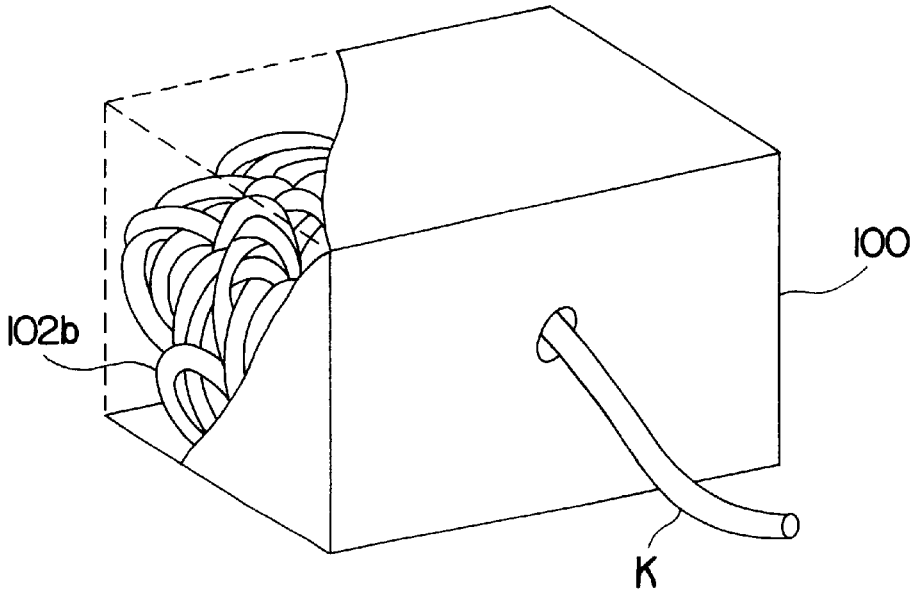
FIG. 12 PRIOR ART
FIG. 12 is a view, similar to that of FIG. 11, of another prior art device.

FIG. 10 shows diagrammatically the relationship between the various forces necessary to withdraw cable K from storage case 10 using various configurations. A is the force needed to withdraw cable out of the top of the case as shown in FIG. 11. If the "pretwist" configuration of the prior art is used (see FIG. 12), the force required is that shown at B. When the cable coil is placed in the storage case without the base, and the outlet opening is on the side of the storage case, the cable could not be withdrawn. This is shown at C. When the sheet is not attached to the base, and the coil is placed in the storage case, the force required is that shown at D. The embodiment of the present Invention (FIGS. 1 and 2) is at E. Thus, the force required in accordance with the present Invention is very small compared to the prior art configurations at A and B.

In essence, the present Invention provides a device whereby the cable can be readily withdrawn from the cable coil through the outlet opening in the side of the case. The disc-shaped base aids in reducing friction and permits the coil to rotate more easily than the prior art. This is especially true when one or more sheets are introduced between the base and the floor of the case and/or a lubricant is provided. This enables easy assembly of the storage case, since the base, carrying the cable coil, need only be inserted into the storage case in a single simple operation.

In the embodiment of the Invention wherein the bearing is provided at the center of the underside of the base, still less friction is encountered. As a further enhancement, a hard sheet is placed between the base and the floor of the storage case. This prevents the bearing from digging into the floor, even if the latter is made of relatively thin cardboard, plastic, or the like. In order to assist in maintaining the structure of the cable coil, a cable support shaft is located on the base and the coiled cable is placed thereover. Thus, the configuration of the cable coil is more easily maintained during withdrawal of the cable itself.

Such changes and modifications of the Invention as would be apparent to the person having ordinary skill in the art may be made without departing from the scope or spirit thereof. The Invention is not to be limited except by the character of the claims appended hereto.

What we claim is:

1. A cable storage assembly comprising a cable storage case, a cable in said storage case and wound around an axis to form a cable coil, and an outlet opening in said storage case to permit said cable to be withdrawn;

said storage case having a planar floor, said axis being substantially perpendicular to said floor, a disc-shaped, planar base on said floor and parallel thereto, a bearing which is a hemisphere between said base and said floor in line with said axis, said base or said floor contacting said bearing at a single point, said cable coil resting on said base whereby, as said cable is withdrawn from said storage case through said outlet opening, said cable coil and said base rotate about said axis.

2. The cable storage assembly of claim 1 wherein said base is provided with a cable support shaft perpendicular to said base and at said axis.

3. The cable assembly of claim 2 wherein said support shaft is non-circular in cross section.

4. The cable assembly of claim 2 wherein said support shaft is polygonal in cross section.

5. The cable assembly of claim 4 wherein said support shaft is hexagonal in cross section.

6. The cable assembly of claim 2 wherein said support shaft has an X-shaped cross section.

7. The cable storage assembly of claim 1 wherein there is a disc-shaped sheet between said base and said floor, a first coefficient of friction between said sheet and base or said floor being less than a second coefficient of friction between said base and said floor.

8. The cable assembly of claim 7 wherein there is at least one additional said sheet between said base and said floor.

9. The cable assembly of claim 1 wherein there is a support between said bearing and said floor.

10. The cable assembly of claim 9 wherein said bearing is mounted on an under surface of said base.

11. The cable assembly of claim 9 wherein said bearing is mounted on an upper surface of said support.

12. The cable assembly of claim 1 wherein a lubricant is between said base and said floor.

13. The cable assembly of claim 1 wherein said outlet opening is in a first side of said case.

14. The cable assembly of claim 13 wherein there are a second side and a third side of said case meeting said first side at edges, said outlet opening being closer to one of said edges than to another.

* * * * *